US008459613B2

(12) United States Patent
McRae

(10) Patent No.: US 8,459,613 B2
(45) Date of Patent: Jun. 11, 2013

(54) DRIVE SYSTEM FOR POTENTIOMETER ADJUSTMENT

(75) Inventor: Samuel McRae, Brentwood, CA (US)

(73) Assignee: Dunlop Manufacturing, Inc., Benicia, CA (US)

( * ) Notice: Subject to any disclaimer, the term of this patent is extended or adjusted under 35 U.S.C. 154(b) by 911 days.

(21) Appl. No.: 12/557,250

(22) Filed: Sep. 10, 2009

(65) Prior Publication Data

US 2011/0030487 A1 Feb. 10, 2011

Related U.S. Application Data

(60) Provisional application No. 61/232,423, filed on Aug. 8, 2009.

(51) Int. Cl.
*B66D 1/26* (2006.01)

(52) U.S. Cl.
USPC ..... 254/278; 74/89.2; 74/514

(58) Field of Classification Search
USPC ..... 254/278; 74/89.2, 514
See application file for complete search history.

(56) References Cited

U.S. PATENT DOCUMENTS

| | | | | |
|---|---|---|---|---|
| 3,872,550 | A * | 3/1975 | Yang | 24/170 |
| 4,161,004 | A * | 7/1979 | Dalziel | 360/267 |
| 4,609,422 | A * | 9/1986 | Becking | 156/502 |
| 4,813,292 | A * | 3/1989 | Boyko | 74/89.2 |
| 5,115,705 | A * | 5/1992 | Monte et al. | 84/617 |
| 7,935,876 | B1 * | 5/2011 | West | 84/304 |

FOREIGN PATENT DOCUMENTS

| | | |
|---|---|---|
| EP | 83101083 | 2/1983 |

* cited by examiner

*Primary Examiner* — Emmanuel M Marcelo
(74) *Attorney, Agent, or Firm* — West & Associates A PC; Stuart J. West; Shaun Sluman

(57) ABSTRACT

A strap-drive system that provides smooth, reliable potentiometer adjustment, particularly in devices used in conjunction with musical instruments.

15 Claims, 4 Drawing Sheets

DRIVE SYSTEM FOR POTENTIOMETER ADJUSTMENT

PRIORITY

This application is related to and claims priority under 35 USC 119(e) to U.S. Provisional Patent Application No. 61/232,423 filed on Aug. 8, 2009, the complete contents of which is hereby incorporated herein by reference.

BACKGROUND

1. Field of the Invention

The present disclosure relates to the field of drive systems for potentiometer adjustment mechanisms, particularly those used in effects pedals that are used in conjunction with musical instruments.

2. Background

Potentiometers are widely used in applications where smooth control of an electrical device is desired, such as in controlling the volume of an audio device. In some devices, a potentiometer is connected to a knob to allow direct rotational adjustment, but in other devices it needs to be able to respond to forces in other directions, such as a linear force. In such devices, linear motion can be translated into rotational motion via a rack-and-pinion or cable-winding mechanism.

Effects pedals are one such device that controls a potentiometer via motion of a pivoting pedal. These pedals are connected between a musical instrument, such as a guitar, and an amplifier. A user rocks a pedal up and down to vary the volume of the guitar through the amplifier and achieve many interesting sound effects. Currently, these pedals use either a rack-and-pinion mechanism or a string to mechanically link the pedal to the potentiometer. Although commonly used in effects pedals, these mechanisms present several drawbacks.

In rack-and-pinion systems, the mechanism requires maintenance, such as lubrication and cleaning, to keep it running smoothly and avoid excessive wear. However, even sufficient maintenance cannot prevent gear lash, or slop, in the drive train to the potentiometer shaft. Further, a rack-and-pinion system can damage a potentiometer. A side load on the rack gear is required to maintain sufficient contact with the pinion gear, which can put a stress on the potentiometer shaft and shorten its life. In addition, a rack-and-pinion drive can skip a tooth and misalign the pedal position and damage the potentiometer. Finally, rack-and-pinion systems can create excessive noise, which could interfere with playing music.

String-drive systems eliminate some of the problems found in rack-and-pinion systems, but also have their own problems. String-drive systems can overlap their windings during use, which can cause excessive string wear, fraying, and eventual failure. When the string or cable breaks, it is difficult to repair. Further, string-drive systems can have tensioning errors during the full travel of the pedal, which requires springs in the drive train.

What is needed is a drive mechanism that can smoothly and quietly adjust a potentiometer, while operating with low friction, low wear, and high reliability.

DETAILED DESCRIPTION

Figure 1:
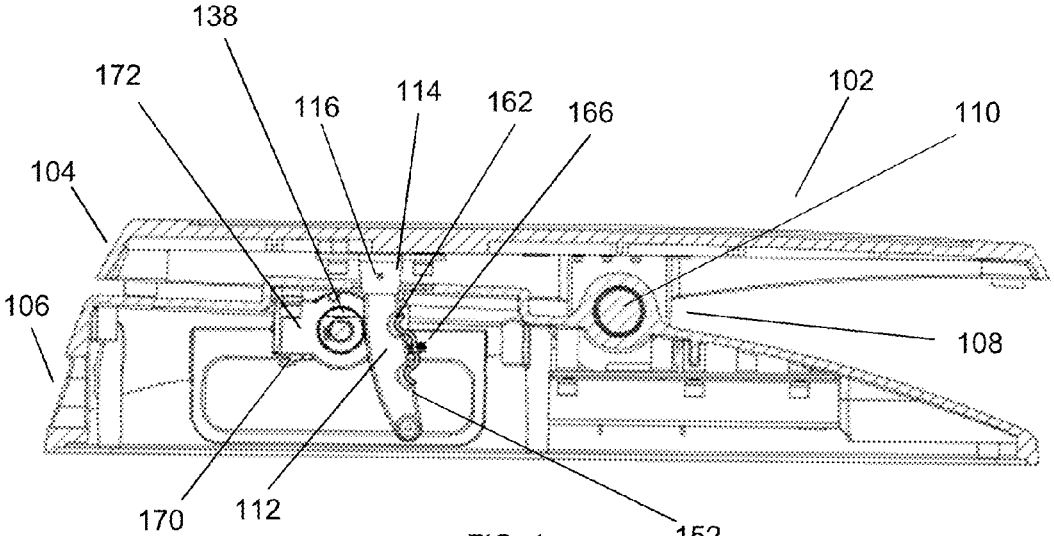
FIG. 1 depicts a side view of one embodiment of the present device.

FIG. 1 depicts a side view of one embodiment of the present device. In some embodiments, as shown in FIG. 1, a pedal device 102 can have a pedal 104 and a base 106. A pedal 104 can be connected to a base 106 at a fulcrum point 108, where a pivot pin 110 running perpendicular to the longitudinal axis of a pedal 104 can allow a pedal 104 to pivot up and down relative to a base 106.

A cam 112 can be connected at one end to a pedal 104 via a cam bracket 114 and a connector pin 116. In some embodiments, as shown in FIG. 1, a cam bracket 114 can be positioned approximately one-third of the length of a pedal 104 at a position forward of a fulcrum point 108, but in other embodiments can be positioned in any known and/or convenient location. A cam 112 can be connected at the other end to a base 106. As shown in FIG. 1, both ends of a cam 112 can be connected such that they can each pivot about an axis parallel to a pivot pin 110.

Figures 1A, 1B, 1C:
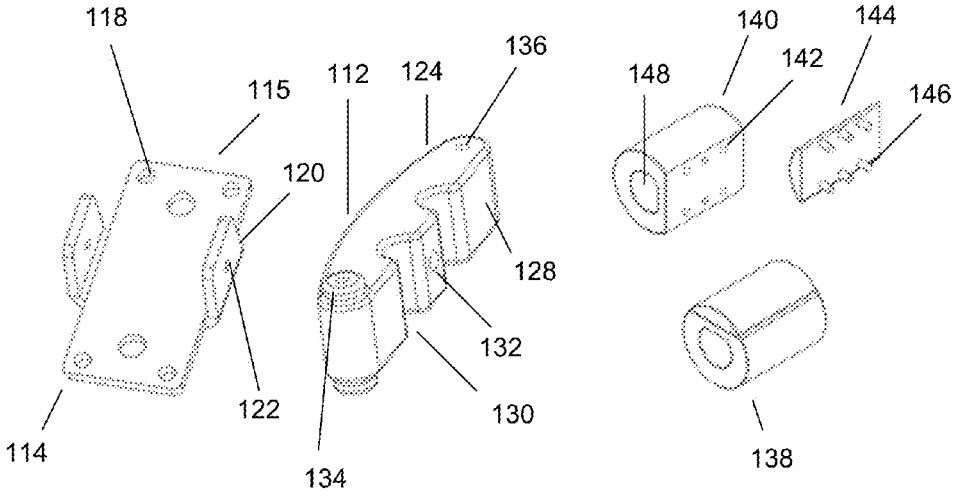
FIG. 1*a* depicts a detail perspective view of a cam bracket component of one embodiment of the present device.
FIG. 1*b* depicts a detail perspective view of a cam component of one embodiment of the present device.
FIG. 1*c* depicts a detail perspective view of a capstan assembly component of one embodiment of the present device.

As shown in FIG. 1*a*, a cam bracket 114 can have an elongated base member 115 that can have a substantially quadrilateral geometry or any other known and/or convenient geometry. A base member 115 can have a plurality of holes 118 to allow said base member 115 to be connected to another surface, such as the underside of a pedal 104. A pair of tabs 120 can extend substantially perpendicularly from substantially parallel edges of a base member 115. In some embodiments, tabs 120 can have a substantially rectangular geometry, but in other embodiments can have any other known and/or convenient geometry. As shown in FIG. 1*a*, in some embodiments, tabs 120 can be located substantially along the midline of a base member 115, or in any other known and/or convenient location. Tabs 120 can have holes 122 oriented perpendicularly to the face of and substantially through the center of said tabs 120 to accommodate a pin 116. In other embodiments, holes 122 can be located in any known and/or convenient position on tabs 120. In some embodiments, a cam bracket 114 can be made from metal, alloy, polymer, composite, polyoxymethylene, glass-filled polyoxymethylene, or any other known and/or convenient material.

As shown in FIG. 1*b*, a cam 112 can have a substantially rounded face 124. As shown in FIG. 1, the radius of curvature of a cam face 124 can correspond to the distance measured from the fulcrum point 108, but in other embodiments can be any other known and/or convenient radius. In other embodiments, a cam face 124 can have an ellipsoid profile or any other known and/or convenient geometry. In some embodiments, the back surface 128 of a cam 112 can be substantially flat, but I other embodiments can include at least one indentation 130. As shown in FIG. 1*b*, an indentation 130 can be a substantially rounded groove that can be oriented perpendicularly across the back surface 128 of a cam 112. In the embodiment shown in FIG. 1*b*, two grooved indentations 130 are located at approximately one-third of the length of a cam 112, but in other embodiments can be any other known and/or convenient geometry and be positioned at any other known and/or convenient location on the back surface 128 of a cam 112. In the embodiment shown in FIG. 1*b*, the back surface 128 of a cam 112 can have a hole 132 positioned substantially at the midpoint between two indentations 130 or an any other known and/or convenient location on the back surface 128 of a cam 112. In some embodiments, a hole 132 can be tapped to accommodate a tensioning screw 166. In some embodiments, a cam 112 can be made from metal, alloy, polymer, composite, polyoxymethylene, glass-filled polyoxymethylene, or any other known and/or convenient material.

At either one or both ends of a cam 112, which, in some embodiments can be substantially rounded, but in other embodiments can be any other known and/or convenient geometry, protrusions 134 can extend perpendicularly from the lateral faces of a cam 112. In some embodiments, protrusions 134 can extend from the lateral faces of a cam 112 at substantially one end of a cam 112. However, in other embodiments, such protrusions can be present at both ends of a cam 112. Although shown in FIG. 1*b* as substantially cylindrical, in other embodiments, protrusions 134 can have any other known and/or convenient geometry. At least one end of a cam 112 can have holes 136 oriented transversely, and said holes 136 can be substantially concentric with protrusions 134 or in oriented in any other known and/or convenient geometry. In some embodiments, holes 136 can be configured to accommodate an expansion pin 116 of any known and/or convenient geometry.

As shown in FIG. 1*c*, in some embodiments a capstan assembly 138 can be substantially cylindrical, but in other embodiments can be any other known and/or convenient geometry. In some embodiments, a capstan assembly 138 can be divided into at least two parts along a longitudinal plane located substantially three-fourths along a cross-section, or any other known and/or convenient location, to produce two complementary pieces. In other embodiments, two parts of a capstan assembly 138 can be integrated. In such embodiments, a cut of a substantially linear or any other known and/or convenient geometry can partially separate two parts of a capstan assembly 138. In some embodiments, as shown in FIG. 1*c*, each part can have at least one substantially flat surface, but in other embodiments can have at least one surface that can be curved or any other known and/or convenient geometry. In such embodiments, a plurality of holes 142 can be oriented perpendicularly to a substantially flat surface of a larger piece 140. A smaller piece 144 can have a plurality of pins 146 extending substantially perpendicularly from a flat surface of a smaller piece 144 that can selectively engage with a plurality of holes 142 in a larger piece 140. In other embodiments, holes 142 can be located on a substantially flat surface of a smaller piece 144 and pins 146 can extend substantially perpendicularly from a substantially flat surface of a larger piece 140. As shown in FIG. 1 *c*, a capstan assembly 138 can have three pairs of substantially parallel pins 146 and three pairs of corresponding holes 142 aligned on either side of the longitudinal axis of a capstan assembly 138. In some embodiments, a capstan assembly 138 can be made from metal, alloy, polymer, composite, polyoxymethylene, glass-filled polyoxymethylene, or any other known and/or convenient material.

As shown in the embodiment in FIG. 1*c*, a larger piece 140 of a capstan assembly 138 can have a substantially cylindrical hole 148 oriented substantially along the central longitudinal axis of a capstan assembly 138. In some embodiments, a substantially cylindrical hole 148 can have at least one substantially flat side to selectively couple with a potentiometer shaft. In some embodiments, a capstan assembly 138 can have a radius having any known and/or convenient ratio to the radius of curvature of a cam face 124 to produce a desired range of rotation of a capstan assembly 138. In some embodiments, this range of rotation of a capstan assembly 138 can be approximately 210 degrees, but in other embodiments, can be any other known and/or convenient quantity.

Figure 1D:
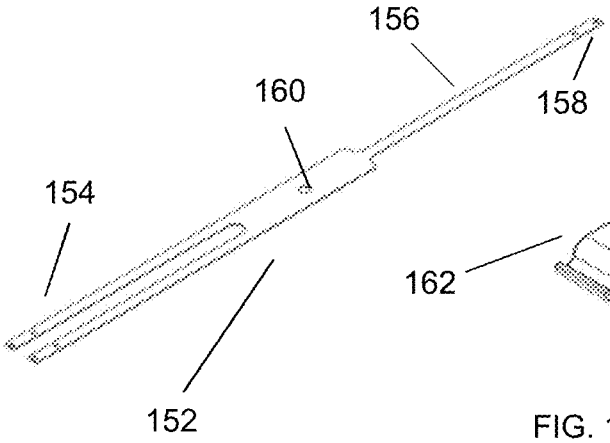
FIG. 1*d* depicts a detail perspective view of a strap component of one embodiment of the present device.

As shown in FIG. 1, a strap 152 can connect a capstan assembly 138 to a cam 112 such that when a cam 112 is moved perpendicularly to the longitudinal axis of a capstan assembly 138, a capstan assembly 138 can rotate about its longitudinal axis. In the embodiment shown in FIG. 1*d*, a strap 152 can have one end that can be divided into a pair of substantially parallel extensions 154 that can each have a length less than one half of the total length of a strap 152 and can each have a width approximately one third of the total width of a strap 152 or any other known and/or convenient dimensions. A pair of substantially parallel extensions 154 can be separated by a distance of approximately one third of the total width of a strap 152 or any other known and/or convenient dimension and or elastomeric relation. The other end of a strap 152 can have an extension 156 that can have a length less than one half of the total length of a strap 152 and can have a width approximately one third of the total width of a strap 152 or any other known and/or convenient dimensions and or geometric relations. As shown in FIG. 1*d*, an extension 156 can be located substantially along the longitudinal midline of a strap 152 or at any other known and/or convenient location.

Extensions 154 and 156 can have at least one hole 158 located substantially at the end of each extension or at any other known and/or convenient location. In some embodiments, as shown in FIG. 1*d*, pairs of holes 158 can be located at each end of extensions 154 and 156. The spacing of each pair of holes 158 can correspond to the configuration of pins 146 and their corresponding holes 142 in a capstan assembly 138 such that a strap 152 can be attached to a capstan assembly 138. Another hole 160 can be positioned at substantially the center of a strap 152. In some embodiments, this hole 160 can be dimensioned to accommodate a tensioning screw 166, or can have any other known and/or convenient dimensions. In some embodiments, a strap 152 can be made from stainless steel, other metal, alloy, polymer, or any other known and/or convenient flexible, durable, thermally-stable, corrosion-resistant material.

Figure 1E:
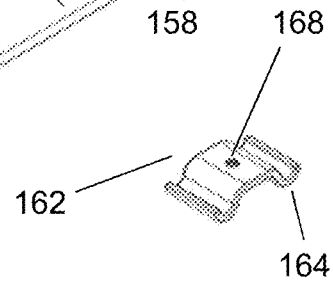
FIG. 1*e* depicts a detail perspective view of a strap bracket component of one embodiment of the present device.

As shown in the embodiment in FIG. 1, a strap bracket 162 can secure a strap 152 to the back surface 128 of a cam 112. As shown in FIG. 1*e*, in some embodiments, a strap bracket 162 can have a substantially quadrilateral planar geometry, but in other embodiments can have any other known and/or convenient geometry. In some embodiments, a strap bracket 162 can have substantially curved ends 164 that can have a geometry corresponding to indentations 130 in the back surface 128 of a cam 112. In such embodiments, a strap bracket 162 can selectively couple with the back surface 128 of a cam 112 and can be adjustably attached with a tensioning screw 166. As shown in FIG. 1*e*, a strap bracket 162 can have a hole 168 located substantially through the center of a strap bracket 162, and in some embodiments, a hole 168 can be tapped to engage a screw or any other known and/or convenient fastener. In other embodiments, curved ends 164 can have any other known and/or convenient geometry. In some embodiments, a strap bracket 162 can be made from metal, alloy, polymer, composite, polyoxymethylene, glass-filled polyoxymethylene, or any other known and/or convenient material.

Figure 2:
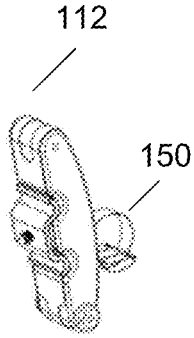
FIG. 2 depicts a perspective view of one embodiment of a strap configuration of the present device.

FIG. 2 depicts a perspective view of the configuration of a strap 152 as it can be wrapped around a capstan assembly 138 and a cam 112. For clarity, a capstan assembly 138 has been cut away to show how a strap 152 can be wrapped around it. When assembled, a capstan assembly 138 can be positioned proximal to a cam face 124. A strap 152 can be oriented substantially perpendicularly to the longitudinal axis of a capstan assembly 138 such that the ends of parallel extensions 154 can be proximal to a capstan assembly 138 and a strap 152 extends away from a cam 112. Holes 158 can align with the outer pairs of pins 146 and holes 142 on a capstan assembly 138 such that the ends of parallel extensions 154 can be held in place. Two complementary parts 140, 144 of a capstan assembly 138 can be joined together with the ends of parallel extensions 154 held between them. Extensions 154 can be wrapped "back" around the outer surface of a capstan assembly 138 such that extensions 154 can be situated between a capstan assembly 138 and a cam face 124. Extensions 154 can travel along a cam face 124, around one end of a cam 112, and wrap around to a back surface 128 such that a central portion of a strap 152 can be positioned on a back surface 128 of a cam 112. Substantially near the opposite end of a cam 112, extension 156 can wrap around a cam 112 to a cam face 124 such that an extension 156 can be situated between a cam face 124 and a capstan assembly 138. An extension 156 can wrap around the outer surface of a capstan assembly 138, opposite extensions 154, such that the holes 158 at the terminal end of an extension 156 can align with an inner pair of pins 146 and holes 142 on a capstan assembly 138 such that the end of parallel extension 156 can be held in place.

In some embodiments, a strap 152 can be wrapped in opposite directions, or in any other known and/or convenient configuration, so that when a strap 152 is pulled taut, it secures a cam 112 to a capstan assembly 138. As shown in FIG. 1, a strap bracket 162 can be aligned with indentations 130 in the back surface 128 of a cam 112 with a strap 152 positioned between a strap bracket 162 and a back surface 128 of a cam 112. A tensioning screw 166 can be adjusted to push a strap bracket 162 against the back surface 128 of a cam 112, such that curved ends 164 of strap bracket 162 can push a strap 152 into indentations 130 to tension a strap 152.

A strap 152 can be wrapped around a cam 112 and a capstan assembly 138 such that when a cam 112 is moved perpendicularly to the longitudinal axis of a capstan assembly 138, a capstan assembly 138 can rotate about its longitudinal axis.

Figure 3:
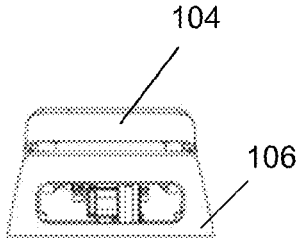
FIG. 3 depicts a front view of one embodiment of the present device.
Figure 4:
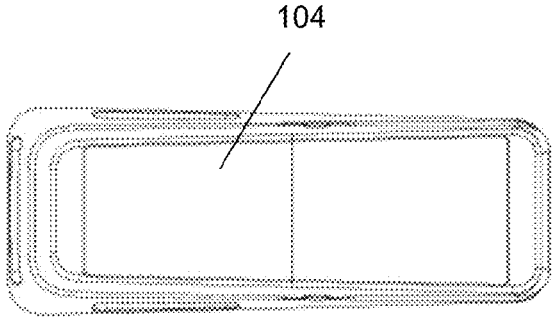
FIG. 4 depicts a top view of one embodiment of the present device.
Figure 5:
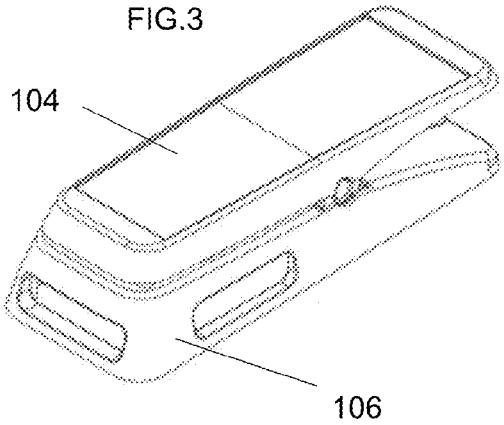
FIG. 5 depicts a perspective view of one embodiment of the present device.

FIG. 3 depicts a front view of the exterior of one embodiment of the present device, showing a pedal 104 and a base 106. FIG. 4 depicts a top view of the exterior of one embodiment of the present device. FIG. 5 depicts a perspective view of the exterior of one embodiment of the present device.

In use, a user applies a force, usually via a foot, to a pedal 104, thereby rotating a pedal 104 about a fulcrum 108. This motion can be translated to a motion of a cam 112. As a cam 112 moves, a strap 152 can wind onto a cam 112, while unwinding the same length of a strap 152 from a capstan assembly 138. This can maintain equilibrium in the length of a strap 152 around a cam 112. In some embodiments, the radius of a cam face 124 can be calculated to be the distance from a fulcrum point 108 of a pedal device 102, so that the cam face 124 can remain tangent to the surface of a capstan assembly 138. In such embodiments, the amount of capstan assembly 138 rotation can be less than 210 degrees, but in other embodiments can be any other known and/or convenient amount of rotation. Further, in such embodiments there can be a fixed first-order relationship between the number of degrees of pedal 104 movement about a fulcrum point 108 and the eventual rotation of a potentiometer shaft.

As a result, a potentiometer can be adjusted smoothly and quietly with a direct relationship between the pedal 104 movement and potentiometer adjustment. Further, no side loading is required to maintain control, which decreased wear on a potentiometer. The force required to change a cam's 112 position need only be applied to one end of a cam 112.

Although the method has been described in conjunction with specific embodiments thereof, it is evident that many alternatives, modifications and variations will be apparent to those skilled in the art. Accordingly, the method as described and hereinafter claimed is intended to embrace all such alternatives, modifications and variations that fall within the spirit and broad scope of the appended claims.

The invention claimed is:

1. A drive system for a potentiometer control mechanism, comprising:

a cam having a top end and a bottom end, a substantially rounded front surface, and a back surface, at least one cam bracket;

wherein the top end of said cam is pivotally connected with said cam bracket;

a capstan assembly, divided longitudinally into at least two parts capable of being selectively mated, wherein one part has a longitudinal hollow portion capable of selectively engaging with a potentiometer shaft;

a strap, having two ends, with a pair of substantially parallel extensions at one end and a single extension at the opposite end, wherein the ends of said strap are held between the parts of said capstan assembly and said strap is disposed about said capstan assembly and said cam;

a strap bracket that couples with the back surface of said cam, and wherein said strap is positioned between the back surface of said cam and said strap bracket.

2. The device of claim 1, wherein said capstan assembly is substantially cylindrical.

3. The device of claim 2, wherein said parts of the capstan assembly each have at least one flat surface, with substantially perpendicular pins on the flat surface of one part and corresponding holes on the flat surface of the other part such that the two parts can be selectively mated together.

4. The device of claim 3, wherein the extensions of said strap have at least one hole located substantially near the distal ends of said extensions that can receive said pins to secure the ends of said extensions in said capstan assembly.

5. The device of claim 1, further comprising a fastener to secure said strap bracket to the back surface of said cam.

6. The device of claim 5, wherein the back surface of said cam has at least one indentation and said strap bracket has a profile geometry capable of selectively coupling with the back surface of a said cam.

7. The device of claim 6, wherein the fastener on said strap bracket is a screw that adjusts the tension on said strap by varying the distance between said strap bracket and the back surface of said cam.

8. The device of claim 1, wherein said strap is disposed about said capstan assembly and said cam such that when said cam moves, the same length of strap is wound or unwound from said cam that is wound or unwound from said capstan assembly.

9. The device of claim 8, wherein the single extension of said strap is disposed about said capstan assembly and the pair or extensions is wrapped around said cam.

10. The device of claim 8, wherein the single extension of said strap is disposed about said cam and the pair of extensions is wrapped around said capstan assembly.

11. The device of claim 1, further comprising a pedal device having a pedal with a top surface and an underside surface and is pivotally connected to a base at a fulcrum point via a pivot pin mechanism, wherein said at least one cam bracket is connected to the underside surface of said pedal in front of said fulcrum point.

12. The device of claim 11, wherein said front surface of the cam has a radius substantially equal to the distance from said front surface of the cam to the fulcrum point of the pedal device.

13. The device of claim 1, wherein the single extension on one end of said strap has a length less than one half of the total length of said strap and has a width approximately one third of the total width of said strap, the pair of substantially parallel extensions each have a length less than one half of the total length of said strap and each have a width approximately one third of the total width of said strap and are separated by a distance of approximately one third of the total width of said strap.

14. The device of claim 1, wherein said strap is made of a material selected from the group consisting of: stainless steel, alloy, corrosion-resistant and thermally-stable metal, polymer, composite, polyoxymethylene, glass-filled polyoxymethylene.

15. The device of claim 1, wherein said cam is made of a material selected from the group consisting of: stainless steel, alloy, corrosion-resistant and temperature-stable metal, polymer, composite, polyoxymethylene, glass-filled polyoxymethylene.

* * * * *